US007302200B2

(12) United States Patent
Washio et al.

(10) Patent No.: US 7,302,200 B2
(45) Date of Patent: Nov. 27, 2007

(54) IMAGE FORMING APPARATUS

(75) Inventors: Takeshi Washio, Kanagawa (JP); Masaharu Yokono, Kanagawa (JP); Kazuosa Kuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 11/284,943

(22) Filed: Nov. 23, 2005

(65) Prior Publication Data

US 2006/0140659 A1 Jun. 29, 2006

(30) Foreign Application Priority Data

Nov. 30, 2004 (JP) ..... 2004-347661
Sep. 5, 2005 (JP) ..... 2005-255966

(51) Int. Cl.
*G03G 15/00* (2006.01)
*G03G 15/02* (2006.01)

(52) U.S. Cl. ..... 399/89; 399/90; 399/50

(58) Field of Classification Search ..... 399/88, 399/89, 90, 50

See application file for complete search history.

(56) References Cited

U.S. PATENT DOCUMENTS 5,754,195 A 5/1998 Yokono
6,898,407 B2 5/2005 Noguchi et al.
6,954,600 B2 * 10/2005 Fujita et al. ..... 399/89
7,139,501 B2 * 11/2006 Takami et al. ..... 399/89
2004/0057737 A1 3/2004 Yokono
2004/0131380 A1 7/2004 Kuma et al.
2004/0208676 A1 10/2004 Ishii et al.
2004/0223790 A1 11/2004 Hosokawa et al.
2005/0008393 A1 1/2005 Kuma et al.
2005/0084293 A1 4/2005 Fukuchi et al.

FOREIGN PATENT DOCUMENTS

JP 5-80639 4/1993

OTHER PUBLICATIONS

U.S. Appl. No. 07/193,676, filed May 13, 1988, unknown.
U.S. Appl. No. 07/496,146, filed Mar. 19, 1990, Takeshi Washio.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus of the present invention includes a pair of support plates supporting the rotary shaft of a photoconductive drum at axially opposite ends of the drum. One of the support plates is openable away from the body of the apparatus and loaded with a contact forming member including a current feed path for feeding a current from a high-tension power supply for charging to a charge roller, a wiring forming a current return path that allows a current to flow from the photoconductive drum to the ground of the power supply, and a plurality of contacts where the wiring and drum contact each other. A current flowing through the current return path is sensed to execute feedback control to the output of the high-tension power supply.

5 Claims, 12 Drawing Sheets

IMAGE FORMING APPARATUS

BACKGROUND OF THE INVENTION

1. Field of the Invention

The present invention relates to a copier, facsimile apparatus or similar image forming apparatus of the type forming an image by an electrophotographic process.

2. Description of the Prior Art

It is a common practice with an image forming apparatus of the type described to uniformly charge the surface of an image carrier with a charger, electrostatically form a latent image on the charged surface of the image carrier, develop the latent image with toner stored in a developing unit to thereby form a corresponding toner image, and transfer the toner image to a sheet or recording medium. While the charger charges the surface of the image carrier by applying a current fed from a high-tension power supply, the charge to be deposited on the above surface is apt to become unstable due to, e.g., the wear or similar deterioration of the image carrier ascribable to aging and due to filming of impurities.

In light of the above, Japanese patent laid-open publication No. 5-010639, for example, proposes a system configured to sense a current returning from an image carrier charged by a charger to the ground of a high-tension power supply and executes, based on the current thus sensed, feedback control to the output of the power supply.

Today, there is an increasing demand for easy, efficient assembly and maintenance of the electric wirings that form a current feed path from high-tension power supply to a charger, a developing unit, image transferring unit or similar image forming section and a current return path that allows a current to be returned from the image forming section to the ground of the power supply, while saving spaces to be allotted to such wirings. To this end, it has been proposed to make one of a pair of support plates supporting, e.g., the axially opposite ends of an image carrier or those of an image forming section openable and mount the above electric wirings on the openable support plate.

More specifically, one of a pair of support plates, supporting an image carrier, an image forming section and so forth at axially opposite ends, generally supports a drive system while the other support plate is located to appear when the cover of an apparatus body is opened. The support plate, appearing when the cover of the apparatus body is opened, is made openable and allows, when opened, a person to maintain the image forming section or remove a sheet jamming it with the image carrier and image forming section held on the support plate on which the drive system is mounted. It is therefore possible to promote easy, efficient assembly and maintenance and save space by arranging electric wirings on the openable support plate.

However, a problem with the openable support plate scheme stated above is that when the support plate is opened, the contact portion of the image carrier and that of a member mounted on the support plate to form a current return path are apt to become unstable due to repeated opening and closing of the support plate. Consequently, the system configured to sense a current returning from an image carrier, as disclosed in laid-open publication No. 5-080639 mentioned earlier, is apt to fail to stably sense the current. Moreover, impurities deposited on the above contact portions or deterioration of the contact portions make current sensing more unstable, so that even the feedback control fails to stabilize the charge and maintain high image quality.

SUMMARY OF THE INVENTION

It is an object of the present invention to provide an image forming apparatus capable of executing stable charge control, promoting easy, efficiently assembly and maintenance and saving space.

An image forming apparatus of the present invention includes a rotatable image carrier and a charger for uniformly charging the surface of the image carrier. A pair of support plates support the image carrier at axially opposite ends of the rotary shaft on which the image carrier is mounted. A current feed path for charging allows a current to be fed from a high-tension power supply for charging to the charger. A current return path allows a current to flow from the image carrier to the ground of the high-tension power supply. The the current flowing through the current return path is sensed in order to execute feed back control to the output of the high-tension power supply for charging. One of the pair of support plates is openable and provided with a contact forming member comprising a member forming the current feed path for charging, a member forming the current return path and a plurality of contacts where the member forming the current return path and image carrier contact each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
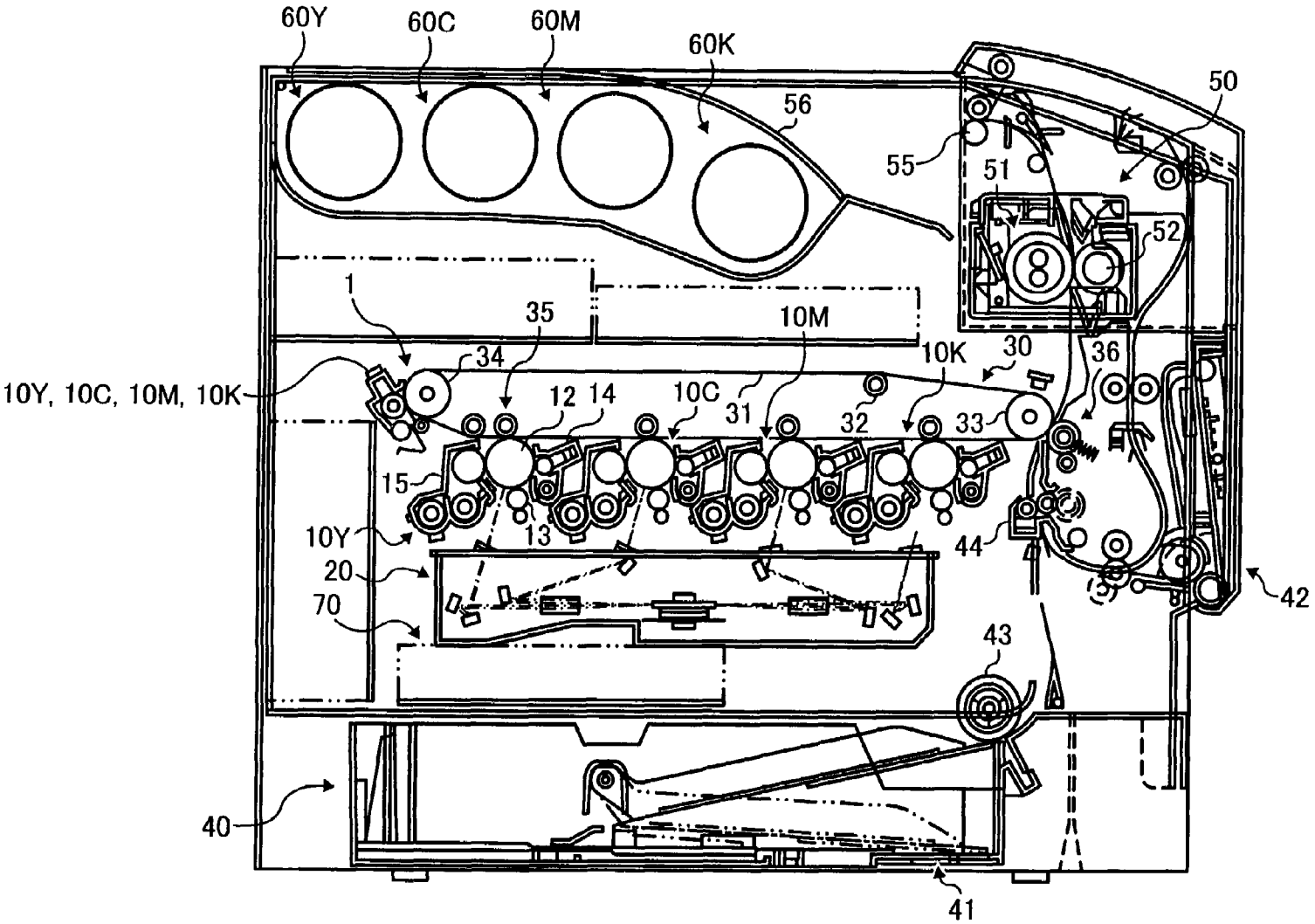
FIG. 1 is a view showing the general construction of an image forming apparatus embodying the present invention.

Referring to FIG. 1 of the drawings, an image forming apparatus embodying the present invention is shown and implemented as a full-color laser printer byway of example. FIG. 1 shows the full-color laser printer (simply printer hereinafter) as seen from the left side of the printer body. As shown, the printer includes a tandem image forming section 1 in which a yellow, a cyan, a magenta and a black image forming means 10Y, 10C, 10M and 10K, respectively, are arranged side by side from the left to the right in FIG. 1. It is to be noted that the suffices Y, C, M and K stand for yellow, cyan, magenta and black, respectively, and apply to various members to be described hereinafter also.

The toner image forming means 10Y, 10C, 10M and 10K include photoconductive drums 12Y, 12C, 12M and 12K, respectively, which are a specific form of an image carrier each. A charger, a developing device, a drum cleaner and so forth are arranged around each of the photoconductive drums (simply drums hereinafter) 12Y, 12C, 12M and 12K, as will be described more specifically later. Because the toner image forming means 10Y through 10K are identical in construction and operation with each other, let the suffices Y, C, M and K be omitted in the following description.

A charger implemented as a charge roller 13, a developing device 15, a drum cleaner 14 and so forth are arranged around each drum 12, which is rotatable clockwise as viewed in FIG. 1. It is to be noted that the image forming means 10Y through 10K each are implemented as a single process cartridge removable from the printer body. More specifically, such a process cartridge can be pulled out of the printer body along guide rails, not shown, affixed to the printer body. Also, when the process cartridge is inserted into the printer body, the toner image forming means 10Y, 10C, 10M or 10K is set in a preselected position.

Toner bottles or toner containers 60Y, 60C, 60M and 60K filled with yellow toner, cyan toner, magenta toner and black toner, respectively, are removably mounted on the upper portion of the printer. The yellow toner, cyan toner, magenta toner and black toner each are replenished from the respective toner bottle 60Y, 60C, 60M or 60K to the associated developing device 15 via a conveyance path, not shown, by a preselected amount.

An optical writing unit or latent image forming means 20 is arranged below the tandem, image forming section 1 and configured to scan the surface of each drum 12 with a particular laser beam in accordance with image data.

An intermediate image transferring unit 30 is arranged right above the tandem image forming section 1 and includes an endless, intermediate image transfer belt 31, which is a specific form of an intermediate image transfer body. The intermediate image transfer belt (simply belt hereinafter) 31 is passed over support rollers 32, 33 and 34. Primary image transfer rollers 35Y, 35C, 35M and 35K sequentially transfer toner images formed on the drums 12Y, 12C, 12M and 12K, respectively, to the belt 31 one above the other, so that a full-color toner image is completed on the belt 31. A secondary image transfer roller or secondary image transfer device 36 is positioned downstream of the primary image transfer rollers 35Y through 35K in the direction of rotation of the belt 31. A support roller 33 faces the secondary image transfer roller 36 with the intermediary of the belt 31 and plays the role of a pressing member.

A sheet feeding unit 40 is positioned beneath the printer and includes a sheet cassette 41 loaded with a stack of sheets and a manual sheet feed tray 42. A pickup roller 43, a registration roller pair 44 and so forth cooperate to convey a sheet P paid out from the sheet cassette 41 or the manual sheet feed tray 42 toward a secondary image transfer station where the secondary image transfer roller 36 is positioned.

A fixing unit 50 is located downstream of the secondary image transfer roller or station 36 in a direction in which the sheet P, carrying the full-color image transferred thereto by the secondary image transfer roller 36, is conveyed. The fixing unit 50 includes a heat roller 51 and a press roller 52 and fixes the toner image on the sheet P with heat and pressure.

In operation, the drums 12Y through 12K of the toner image forming means 10Y through 10K, respectively, are caused to rotate while the chargers 13Y through 13K uniformly charge the surfaces of the drums 12Y through 12K, respectively. Subsequently, the optical writing unit 20 scans the charged surface of each of the drums 12Y through 12K with a particular light beam in accordance with image data, forming latent images on the drums 12Y through 12K. The developing devices 15Y through 15K each develop the latent image formed on associated one of the drums 12Y through 12K with toner of a particular color. Consequently, a yellow, a cyan, a magenta and a black toner image are formed on the drums 12Y, 12C, 12M and 12K, respectively. While the belt 31 is caused to turn by a motor, not shown, the yellow, cyan, magenta and black toner images are sequentially transferred from the drums 12Y, 12C, 12M and 12K, respectively, to the belt 31 one above the other, completing a composite or full-color image on the belt 31. After such primary image transfer from the drums 12Y through 12K to the belt 31, the drum cleaners 14Y through 14K remove residual toners left on the drums 12Y through 12K, respectively, thereby preparing the drums 12Y through 12K for the next image formation.

A sheet P is fed from the sheet cassette 41 or the manual sheet feed tray 42 toward the registration roller pair 44 in synchronism with the image formation stated above. The registration roller pair 44 once stops the sheet P for correcting a skew and again conveys it to the secondary image transfer station between the secondary image transfer roller 36 and the belt 31 in synchronism with the image formation. At the secondary image transfer station, i.e., a nip between the belt 31 and the roller 36, the full-color image is transferred from the belt 31 to the sheet P (secondary image transfer).

The sheet P, now carrying the full-color image thereon, is introduced into the fixing unit 50 and has the full-color image fixed by heat and pressure. The sheet or print P is then driven out of the printer body. On the other hand, a belt cleaner removes residual toner left on the belt 31 after the secondary image transfer for thereby preparing the belt 31 for the next image formation.

Figure 2:
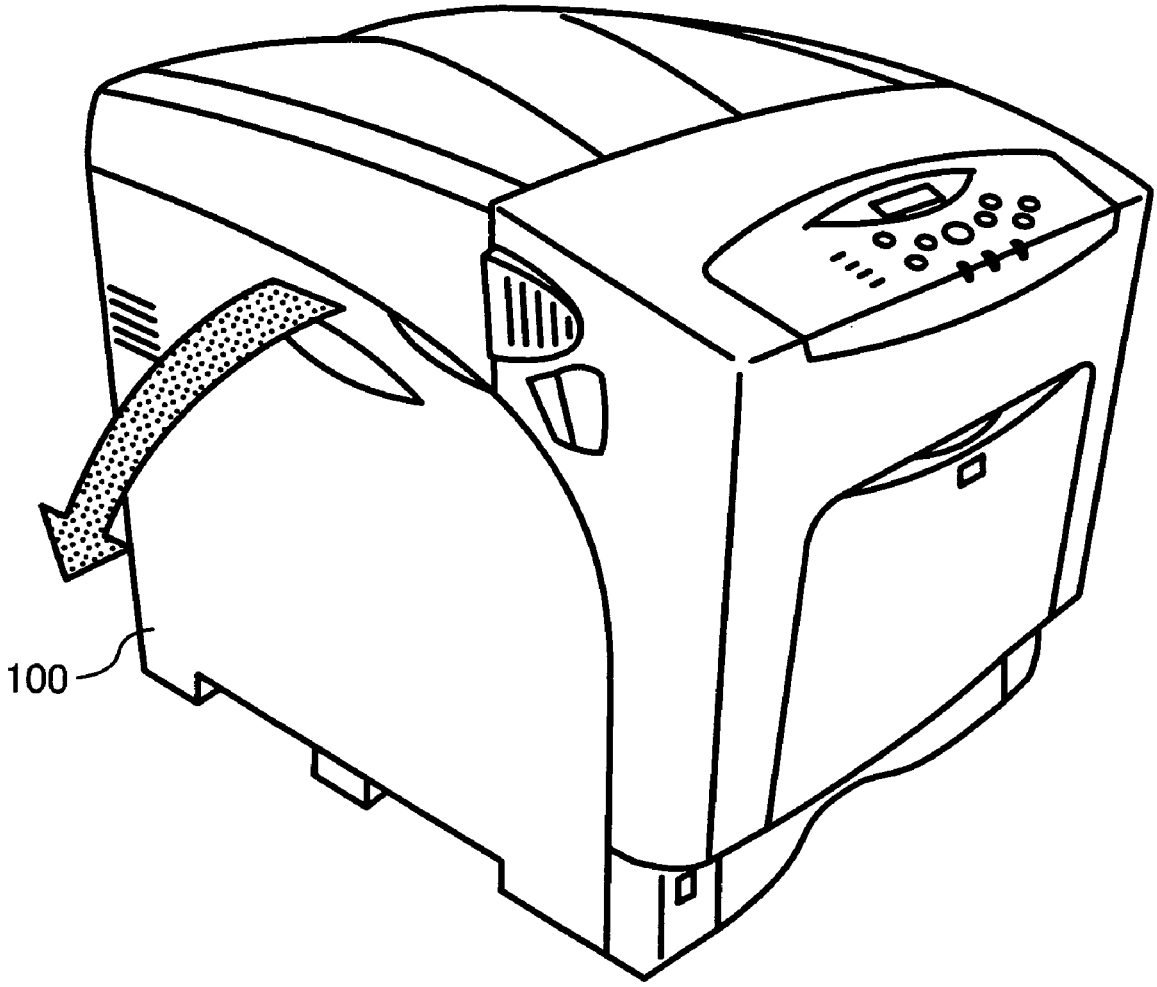
FIG. 2 is an external isometric view of the illustrative embodiment.

Arrangements unique to the illustrative embodiment will be described specifically hereinafter. FIG. 2 is an external isometric view showing the printer body of the illustrative embodiment. As shown, the printer body includes a cover 100 openable to the left side, as indicated by an arrow in FIG. 2.

Figure 3:
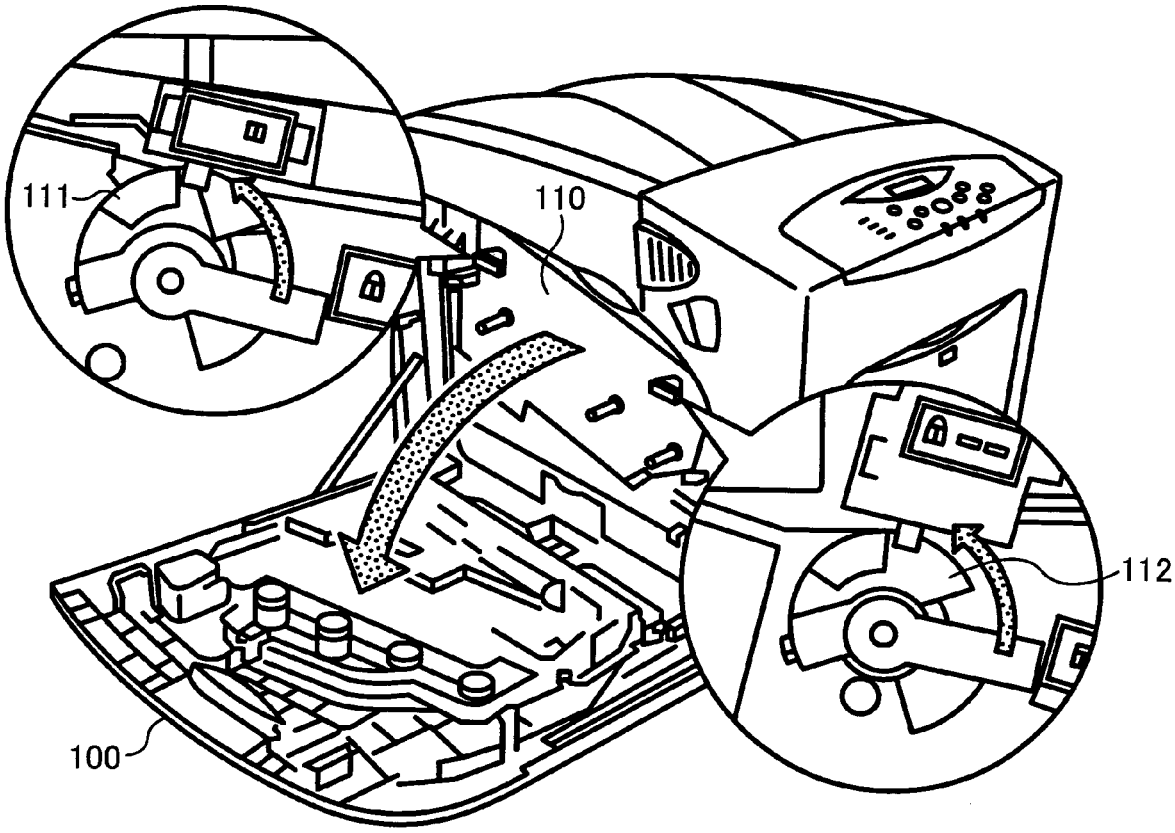
FIG. 3 shows the inside of the illustrative embodiment that appears when a cover is opened.

FIG. 3 shows the inside of the printer that appears when the cover 100 is opened. As shown, when the cover 100 is opened, a support plate 110, supporting the tandem image forming section 1 including the drums 12, chargers 13, developing devices 15, intermediate image transferring unit 30, drum cleaners 14 and so forth, is uncovered. Another support plate, not shown, is positioned at the rear side of the tandem image forming section 1, as viewed in FIG. 3, and supports the tandem image forming section 1 in cooperation with the support plate 110. A drive system, not shown, is mounted on the rear support plate and configured to drive the intermediate image transferring unit 30, drums 12 and chargers 13 of the toner image forming sections 10Y through 10K and rollers included in the developing devices 15.

Figure 4:
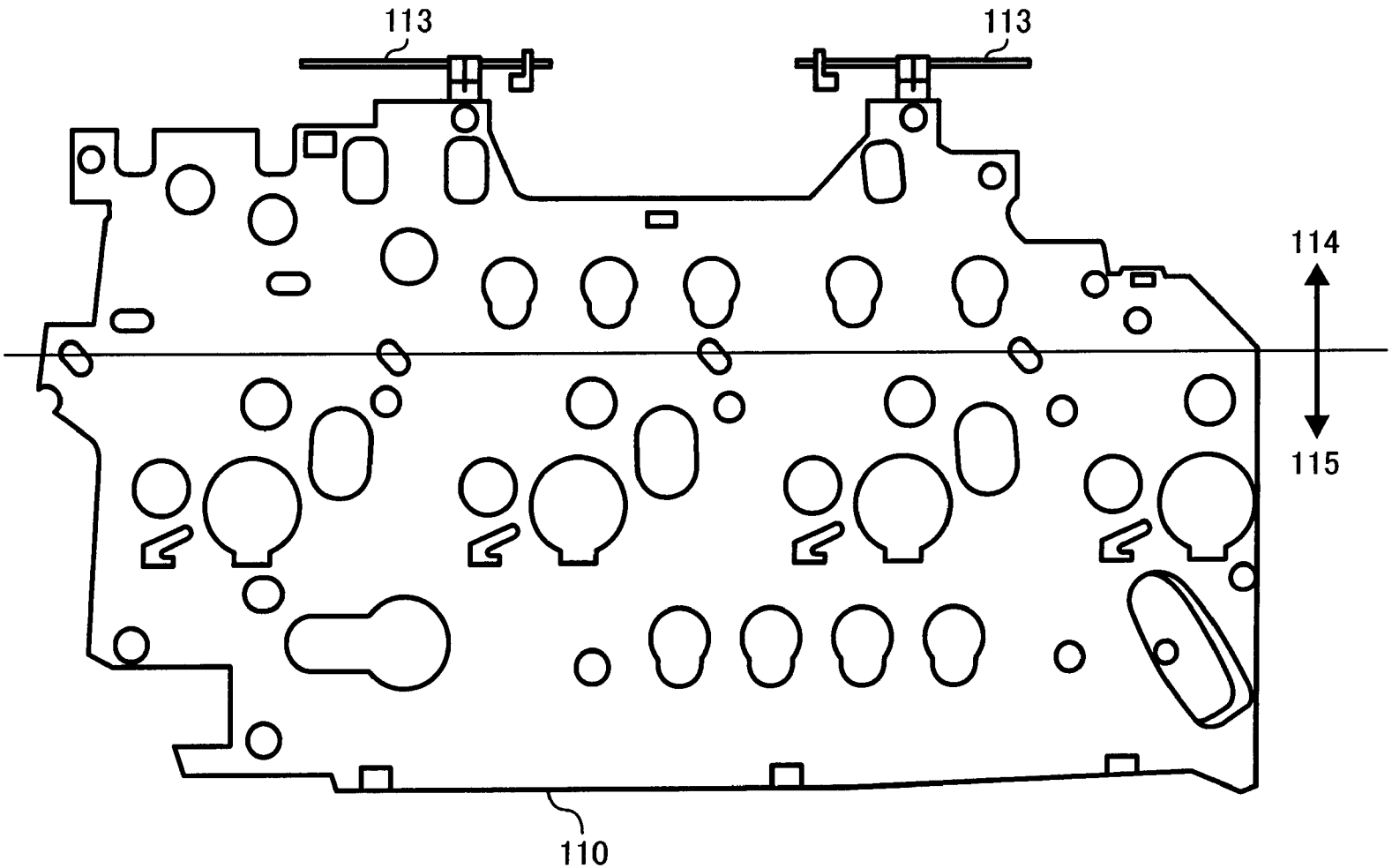
FIG. 4 shows a support plate included in the illustrative embodiment, as seen from a tandem image forming section side.

FIG. 4 shows the support plate 110 as seen from the tandem image forming section 1 side. As shown, the support plate 110 is rotatably supported by a shaft 113 at the lower end thereof in such a manner as to be openable by more than 90 degrees about the shaft 113. Locking members 111 and 112, see FIG. 3, are mounted on upper opposite sides of the support plate 110 and usually positioned to lock the support plate 110 to the printer body. To open the support plate 110, a person moves the locking portions 111 and 112 to unlocking positions and then opens the support plate 110 away from the printer body. Conversely, to close the support plate 110, the person raises the support plate 110 toward the tandem image forming section 1 to a position where holes formed in the support plate 110 and bosses formed on the tandem image forming section 1 mate with each other, i.e., the support plate 110 and printer body, including the section 1, mate with each other, and then returns the locking members 111 and 112 to the original locking positions so as to insure close engagement.

In the illustrative embodiment, an arrangement is made such that when the support plate 110 is opened, the tandem image forming section 1 remains supported by the rear support plate, not shown, allowing the maintenance of the image forming section 1 and replacement of any one of the process cartridges to be performed.

Wirings, or a wiring system, for feeding a current to the intermediate image transferring unit 30 and chargers 13 and developing devices 15 included in the toner image forming sections 10Y through 10K are arranged on the openable support plate 110. Also arranged on the support plate 110 is a current return path along which a current is returned from the drums 12 of the toner image forming sections 10Y through 10K to the ground of a high-tension power supply. Further, a wiring for sensing a feedback current to flow through the current return path is arranged on the support plate 110. Such current feed wirings and current return path will be described more specifically later.

The rear support plate, supporting the drive system assigned to the tandem image forming section 1, and openable, front support plate 110, supporting the wirings for feeding a current to the image forming section 1, are so positioned as to support the axially opposite ends of the image forming section 1. By so mounting the electric wirings on the openable support plate 110, it is possible to promote easy, efficient assembly and maintenance while saving space.

As shown in FIG. 4, input contact pins 114 are mounted on the lower portion of the support plate 110 for feeding a current from a power supply mounted on the printer body to the chargers 13, developing devices 15, image transferring units 30 and other units necessary for image formation. Also, output contact pins 115 are mounted on the upper portion of the support plate 110 for allowing currents from the above units to flow therethrough. Current feed terminals from a high-tension power supply unit 70, see FIG. 1, are positioned in front of the optical writing unit 20 in such a manner as to face the input contact pins 114 of the support plate 110. Further, current return terminals, not shown, for returning currents from the intermediate image transferring unit 30, drums 12 of the toner image forming sections 10Y through 10K, chargers 13 and developing devices 15 to ground are positioned to face the output contact pins 115 of the support plate 110.

Wirings are arranged in the support plate 110 such that the input contact pins 114 and output contact pins 115 of the support plate correspond one-to-one to the current feed terminals and current return terminals of the above units, respectively. When the support plate 110 is closed, the contact pins of the support plate 110 are brought into contact with the terminals of the high-tension power supply unit 70, drums 12, chargers 13, developing devices 15 and image transferring unit 30, allowing a current to flow to such units.

Figure 5:
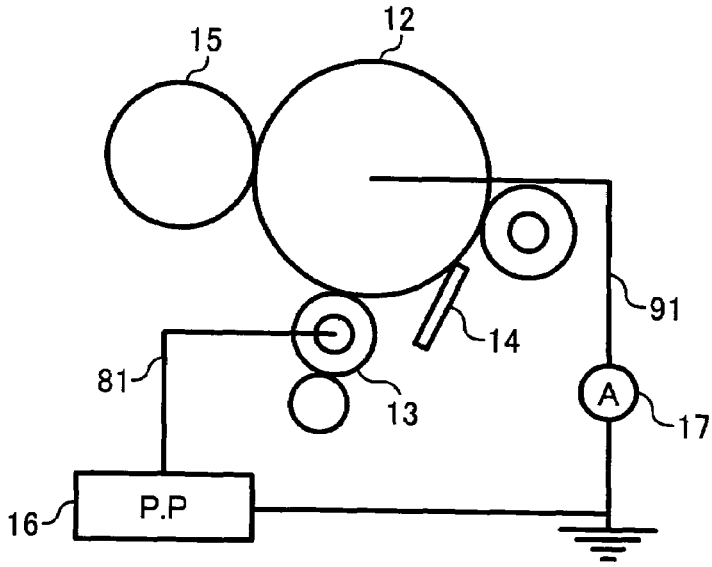
FIG. 5 demonstrates how a photoconductive element is charged in the illustrative embodiment.

FIG. 5 shows circuitry for charging the drum 21. As shown, a current output from an exclusive high-tension power supply 16 for charging is routed through a current feed path 81 arranged in the support plate 110 and charger roller 13, so that a charge is deposited on the surface of the drum 12. A feedback current is returned from a conductive rotary shaft 12*a*, which supports the drum 12, to the ground of the high-tension power supply 16 via a current return path 91 also arranged in the support plate 110. By sensing the feedback current and feeding it back to the input side, it is possible to obtain an adequate charge potential.

Figure 6:
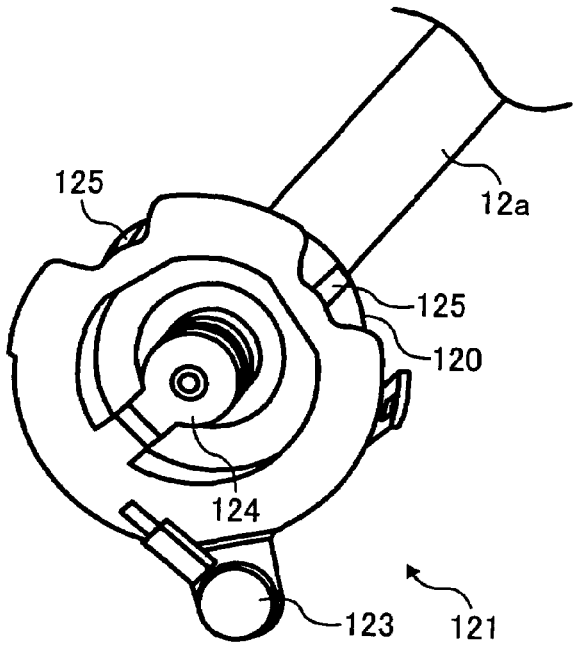
FIG. 6 shows a contact forming member also included in the illustrative embodiment and the photoconductive drum contacting each other.

FIG. 6 shows a specific configuration of a contact forming member 121 and rotary shaft 12*a* supporting the drum 12. As shown, the shaft 12*a* of the drum 12 is freely rotatably supported by, e.g., a conductive bearing 120. The contact forming member 121 mounted on the support plate 110 is held in contact with the conductive bearing 120. The contact forming member 121 includes a portion 124 contacting the end of the shaft 12*a* from the direction of thrust and a portion 125 contacting the bearing 120. Further, the contact forming member 121 includes a conductor fixing member 123 for connecting the bearing 120 to a wiring which is provided in the support plate 110 for sensing a feedback current. The contact forming member 121 is fixed to an insulating portion included in the support plate 110 via a connecting member not shown. The contact forming member 121 should only be conductive and has some degree of resilience and is therefore implemented by a leaf spring formed of stainless steel in the illustrative embodiment. The end of the shaft 12*a* supporting the drum 12 and part of the contact forming member 121 contacting it wear due to the frictional force of the drum 12 in rotation, insuring conductivity at all times.

As stated above, in the illustrative embodiment, the contact forming member 121 is implemented by a single member including the contact portion 124, which contacts the shaft 12*a* of the drum 12 from the direction of thrust and therefore has a self-cleaning function, and contact portion 125 capable of being pressed against the bearing 120.

Figure 7A:
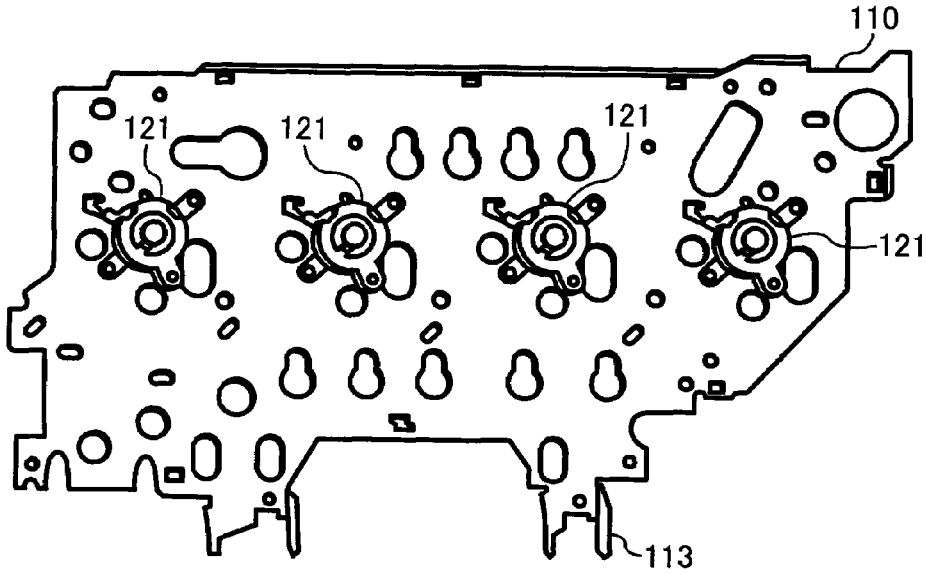
FIG. 7A shows the support plate provided with the contact forming member, as seen from the back of the side facing the tandem image forming section.
Figure 7B:
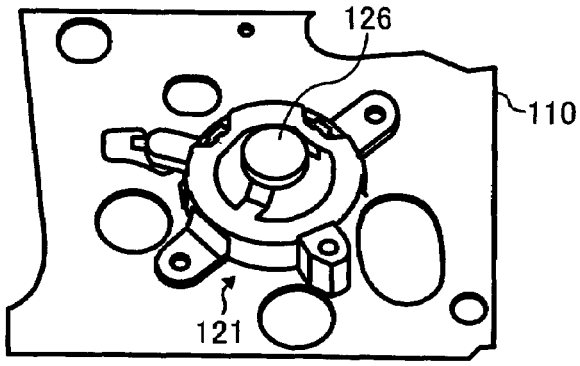
FIG. 7B is an enlarged view showing part of the contact forming member.
Figure 7C:
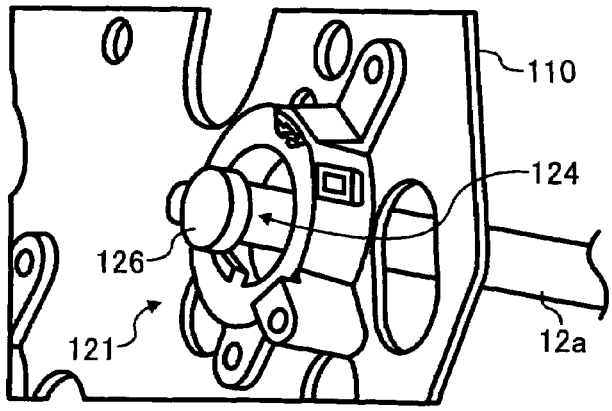
FIG. 7C shows the contact forming member and the shaft of the photoconductive drum contacting each other.
Figure 8A:
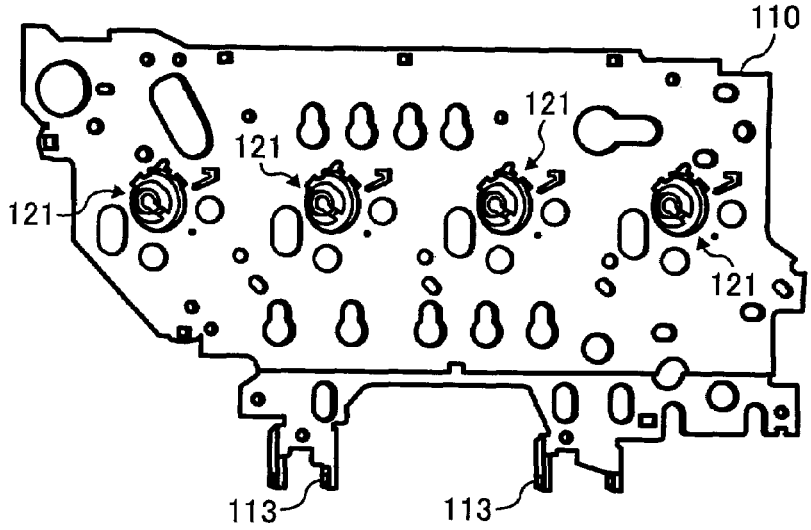
FIG. 8A shows the support plate provided with the contact forming member, as seen from the side facing the tandem image forming section.
Figure 8B:
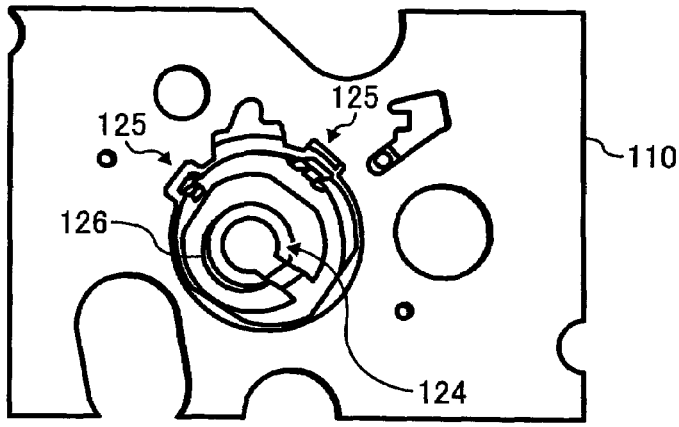
FIG. 8B is an enlarged view showing part of the contact forming member.
Figure 8C:
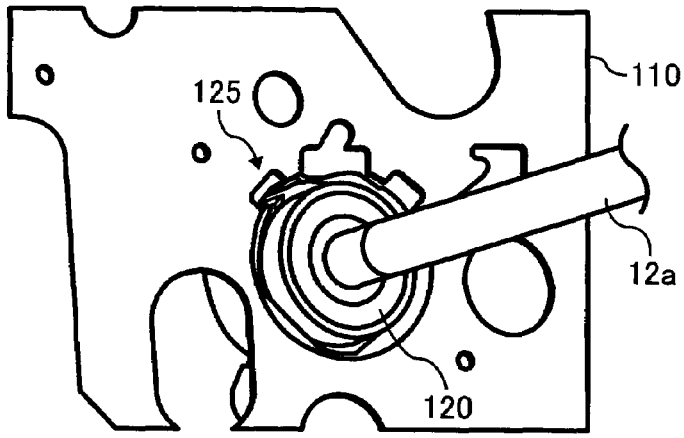
FIG. 8C shows the contact forming member and the rotary shaft of the photoconductive drum contacting each other.

FIG. 7A shows the support plate 110 provided with four contact forming members 121, as seen from the back of the side that faces the tandem image forming section 1, while FIG. 7B shows one of the contact forming members 121 in an enlarged scale. Further, FIG. 7C shows how the contact forming member 121 and the rotary shaft 12*a* of the drum 12 are held in contact with each other. FIG. 8A shows the configuration of the support plate 110 provided with the contact forming members 121, as seen from the side that faces the tandem image forming section 1, while FIG. 8B shows one of the contact forming members 121 in an enlarged scale. FIG. 8C show how the contact forming member 121 and shaft 12*a* are held in contact with each other.

As shown, a resilient member 126 is mounted on a portion 124 of the contact forming member 121 which the end of the shaft 12*a* of the drum 12 contacts, pressing the shaft 12*a* with a preselected pressure toward the axis of rotation of the shaft 12*a*. When the support plate 110 is raised or closed toward the tandem image forming section 1, holes formed in the support plate 110 and bosses formed on the printer body mate with each other. At this instant, the end of the shaft 12*a* and the portion 124 of the contact forming member 121 corresponding thereto contact each other while the bearing 120 and the portion 125 contact each other. Such contact is made closer because the contact forming member 121 elastically deforms to a preselected position. In addition, when the locking members 111 and 112 are returned to their original locking positions, the contact forming member 121 is further deformed to set the drum 12 at a preselected position in the axial direction.

However, if the drum 12 is rotated in the condition stated above, a strong force is likely to act in the axial direction of the shaft 12*a* due to friction acting between the end of the shaft 12*a* and the contact forming member 121, causing the end of the shaft 12*a* and contact forming member 121 to oscillate in the axial direction and part from each other.

In light of the above, in the illustrative embodiment, a resilient cover, not shown, is positioned at the back of the support plate 110, which is opposite to the tandem image forming section 1, and presses the resilient member 126 in the axial direction of the shaft 12*a*, surely maintaining the end of the shaft 12*a* and contact forming member 121 in contact with each other by following the oscillation. The resilient member 126 may be implemented as a single member including a bent contact portion or by a coil spring, rubber member, leaf spring or similar member independent of the contact forming member 121.

With the above configuration, it is possible to stably sense a feedback current even when the contacts are deteriorated due to aging or smeared and to stabilize a return current by obviating a difference in sensed potential between the portions contacting each other. Thus, by feeding back a current to the input side, there can be implemented stable charging. In addition, there can be promoted easy, efficiently assembly and replacement. It is to be noted that the contact forming member 121 may be provided with a plurality of portions 125 contacting the bearing 120.

Wirings arranged in the support plate 110 will be described in detail hereinafter. Wirings are arranged in the support plate 100 for feeding a current from the high-tension power supply unit 70 mounted on the printer body to the chargers 13, developing devices 15, image transferring unit 30 and other various units necessary for image formation, as stated previously. Also arranged in the support plate 100 are a current return path for allowing currents to flow from the drums 12 to the ground of the power supply unit 70 and a wiring 17, see FIG. 5, for sensing a feedback current flowing through the current return path. Arranging such various wirings different in voltage or current from each other in a single support plate 110 is desirable because the support plate 110 occupies only a small space.

However, if the wirings, each causing a particular current to flow therethrough, are positioned excessively close to each other or parallel to each other, it is likely that the wirings interfere with each other and cause currents flowing therethrough to oscillate. Particularly, on the current return path through which a feedback current flows, the feedback current oscillates and prevents accurate feedback from being applied to the voltage to be applied to the charge roller, leaving the problem that the charge potential of the drum 12 becomes unstable left unsolved.

To solve the problem stated above, in the illustrative embodiment, a wiring 80 for feeding a current to the charger 13, developing device 15, image transferring unit 30, drum cleaner and other units and the current return path 91 along which a feedback current flows are spaced from each other by a preselected distance. If the wirings 80 and 91 are required to intersect each other for layout reasons, they are so arranged as to intersect each other substantially perpendicularly to each other.

Figure 9:
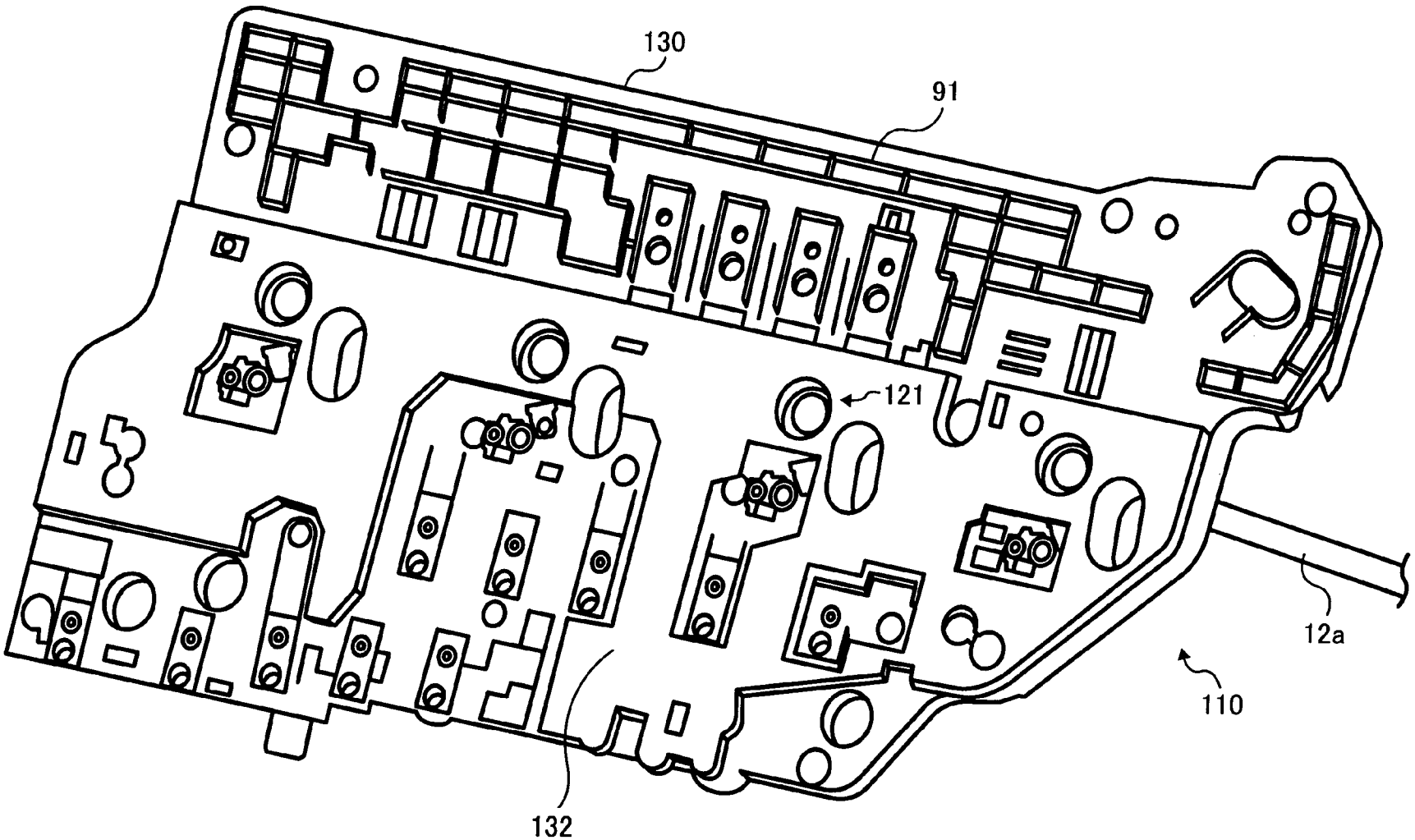
FIG. 9 shows the support plate loaded with wirings, as seen from the back of the side facing the tandem image forming apparatus.

Reference will be made to FIGS. 9 through 13 for describing the wirings of the illustrative embodiment more specifically. FIG. 9 shows the support plate 110 with the wirings, as seen from the back of the side facing the tandem image forming section 1. As shown, a base holder 130 formed of insulating resin, a current feed holder 131 for charging and a current feed holder 132 for development are arranged on the back of the side of the conductive support plate 110 facing the tandem image forming section 1. The wiring 91 for sensing a feedback current is arranged at opposite side to the tandem image forming section 1.

Figure 10:
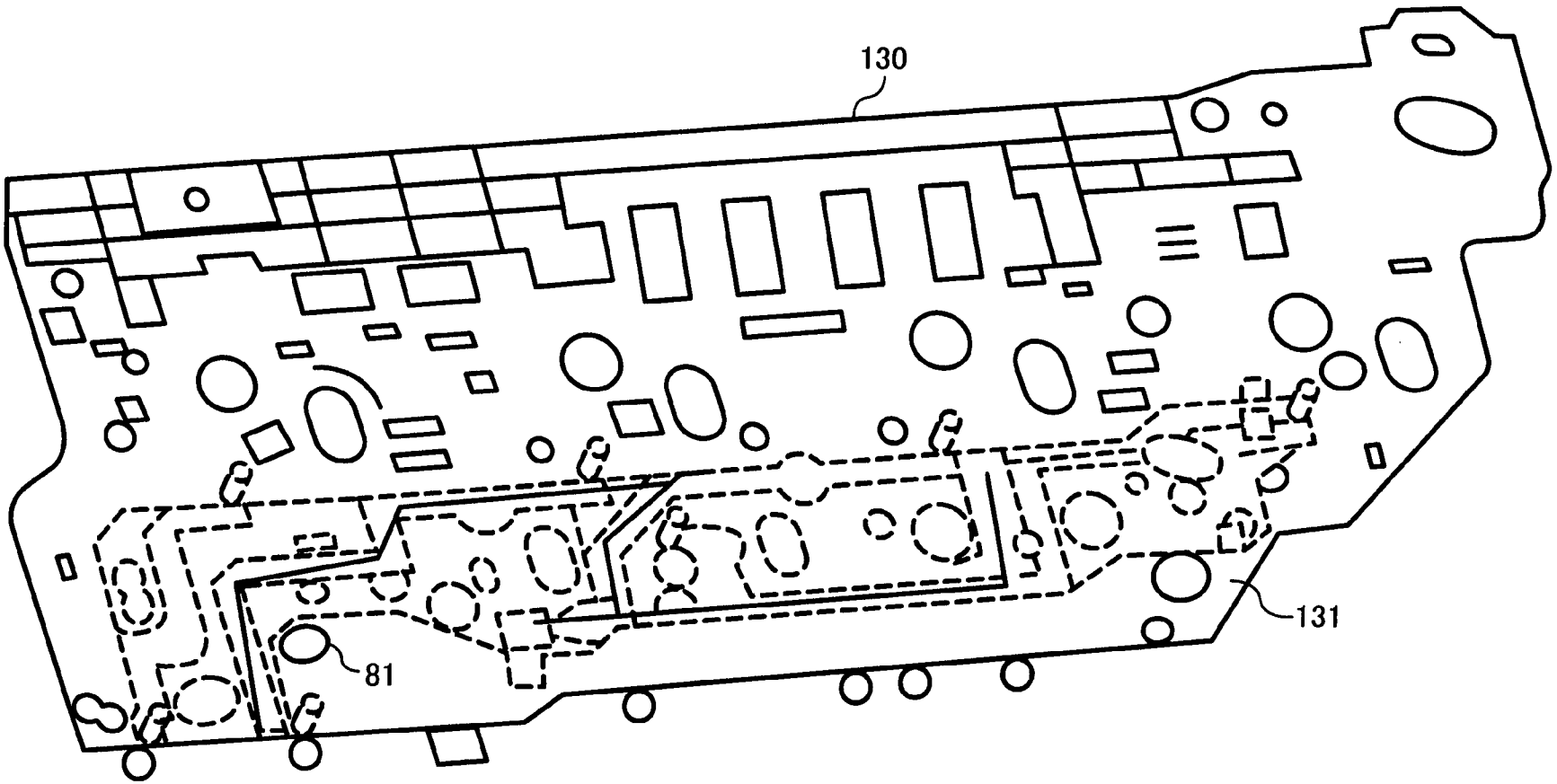
FIG. 10 shows a current feed holder for charging included in the illustrative embodiment and a base holder on which the current feed holder is mounted.

As shown in FIG. 10, the current feed holder 131 for charging is fixed to the side cover side of the base holder 130 while sandwiching the current feed wiring 81 for charging.

Figure 11:
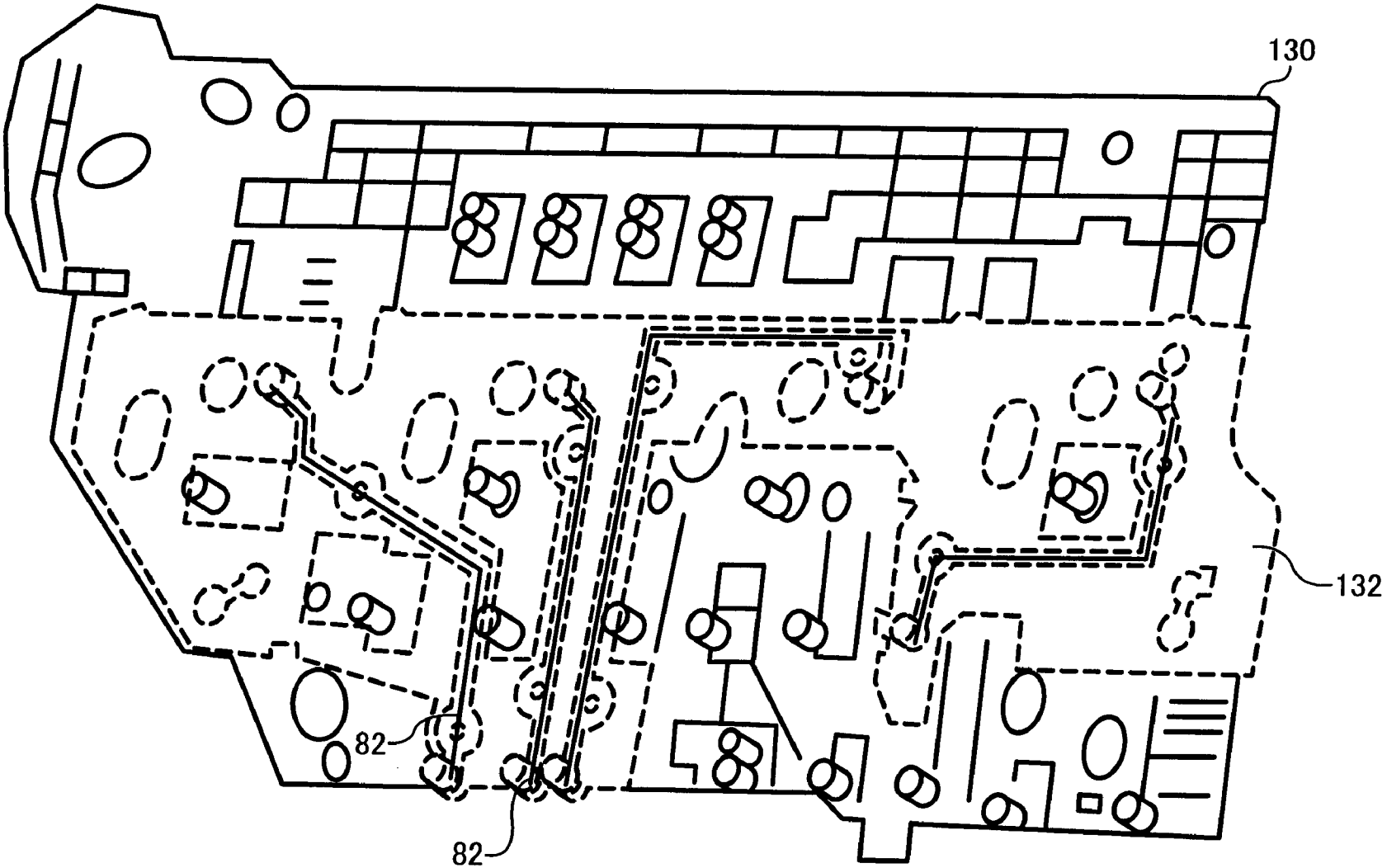
FIG. 11 shows a current feed holder for development included in the illustrative embodiment and the base holder on which the current feed holder is mounted.

As shown in FIG. 11, the current feed holder 132 for development is fixed to the tandem image forming section side of the base holder 130 while sandwiching current feed wirings 82 for development. The current feed holder 131 for charging and current feed holder 132 for development are snap-fitted or otherwise fixed to the base holder 130 at preselected positions from opposite sides of the base holder 130. Such holders in combination constitute the input and output portions of the support plate 110 with a conductor, which connects the input and output ends, being fixed to insulating resin and having opposite ends thereof connected to contact pins.

Figure 12:
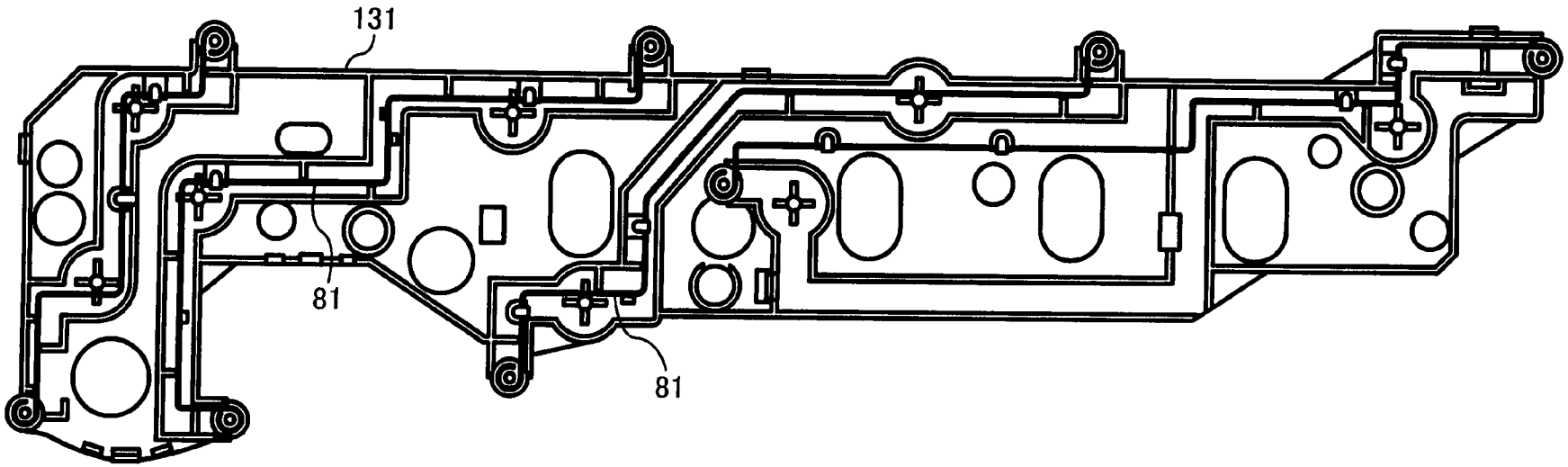
FIG. 12 shows the inside surface of the current feed holder for charging.
Figure 13:
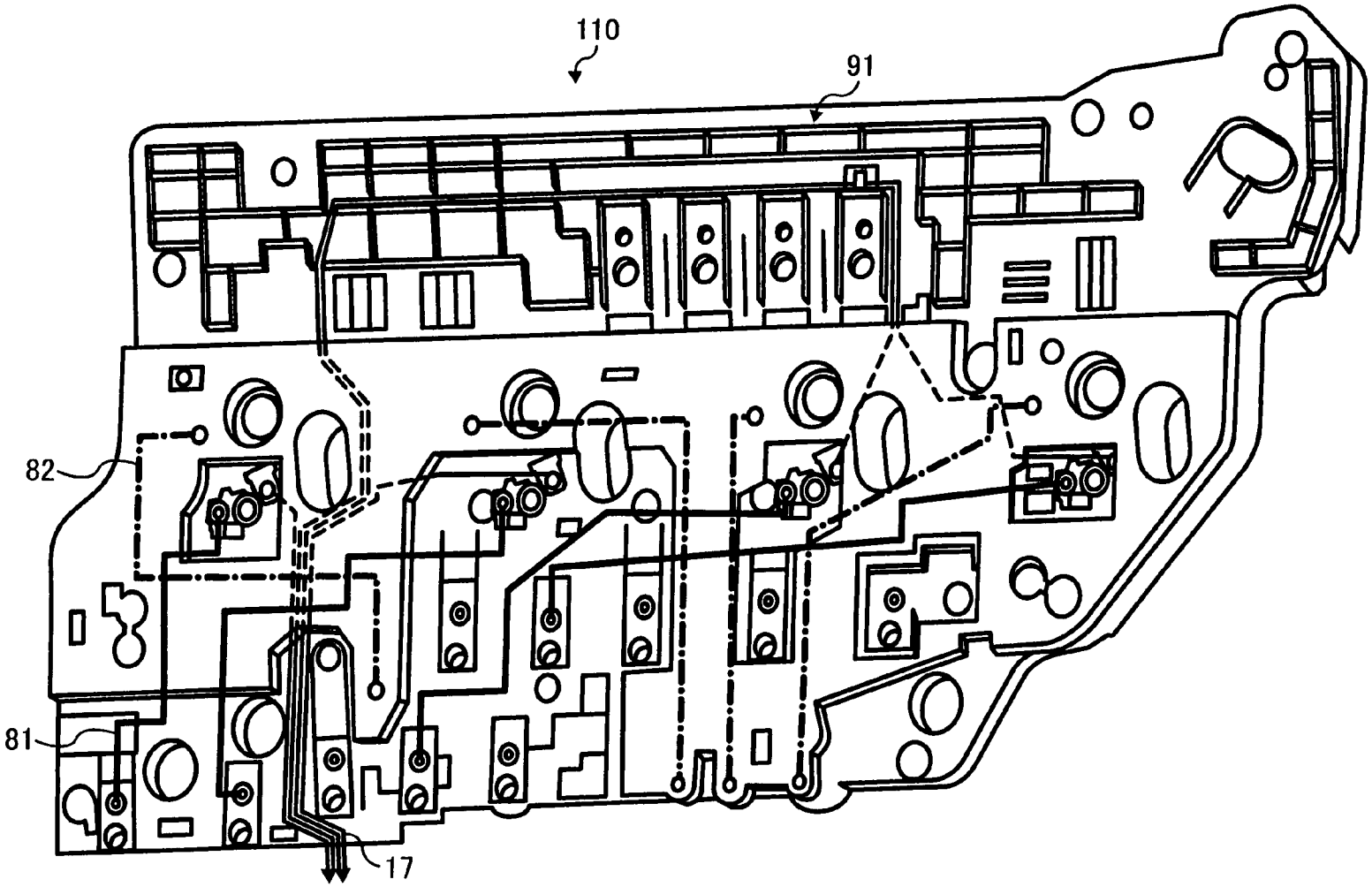
FIG. 13 shows the wirings more specifically.

FIG. 12 shows the inside surface of the current feed holder 131 for charging on which the current feed wirings 81 for charging are positioned. FIG. 13 shows the arrangement of the current feed wirings 81 for charging, wiring 91 for sensing a feedback current and current feed wirings 82 for development.

Thus, the feed wirings 81 for charging and feed wirings 82 for development are positioned apart from each other by a preselected distance in the support plate 110 by the base holder 130, current feed holder 131 for charging and current feed holder 132 for development. Also, the current feed wirings 81 and 82 are positioned apart from the return path 91 by a preselected distance via the insulator. Further, the current feed wirings 81 for charging and feedback return path 91 intersect each other perpendicularly to each other when required to intersect each other for layout reasons.

More specifically, a voltage applied to, among the current feed wirings 80, the current feed wirings 82 for development is about 300 V to about 500 V in absolute value by way of example. AS for the current feed wirings 81 for charging, a DC voltage of about 500 V to about 700 V in absolute value, which may be biased by an AC voltage of about 1,700 V to about 2,000 V in peak-to-peak value, is applied. Further, the wiring 91 for sensing a feedback current is applied with a DC voltage of about several volts selectively biased by an AC voltage of about several ten volts in peak-to-peak value. When voltages assigned to two wirings are noticeably different from each other, as stated above, the wiring assigned to a high voltage is apt to effect the voltage or current of the wiring assigned to a low voltage in dependence on the positional relation between the wirings. In light of this, in the illustrative embodiment, nearby wirings are spaced from each other by at least 2 cm or so in order to avoid interference.

The current feed paths 81 for charging are implemented by thin wires formed of metal because thin metallic wires are free from electric interference. The diameter of the thin wires should preferably be 1 mm or less. In practice, use may be made of stainless steel wires (SUS 304-WPB), phosphor bronze wires (C5191W-H), hard copper wires (SW-C) or similar conductive wires. With charge paths implemented by such thin wires, it is possible to reduce capacitance between charge paths and metallic parts adjoining them and therefore to apply a desired voltage or current.

As stated above, in the illustrative embodiment, current feed paths for charging and a current return path are accommodated in a single support plate 110 in order to facilitate assembly and maintenance of wirings and save space. The contact forming member 121 may be formed with a plurality of contacts where the current return path in the support plate 110 and drums 12 contact. This is successful to accurately sense a current and therefore to insure stable charge potential even when one of the contacts is smeared or deteriorated due to aging. Also, by forming a plurality of contacts with a single contact forming member, it is possible to obviate a potential difference between the contacts for thereby insuring stable current sensing and enhancing easy assembly and maintenance.

The current feed paths 81 for charging, current feed paths 82 for development and current feed paths for image transfer, which are arranged in the support plate 110 are isolated from each other by the insulative holders 130, 131 and 132. Also, the current feed paths 81 and 82 and current feed paths for image transfer are isolated from the current return path 91 by an insulating member. When any one of such current feed paths intersects the current return path 91, they are so configured as to intersect each other substantially perpendicularly to each other. With such arrangements, it is possible to electrically guide the individual wirings for thereby obviating interference despite that the wirings are collectively arranged in the same support wall 110.

The current feed wirings inside the support plate 110 are implemented by thin wires formed of metal. This successfully reduces capacitance between the current feed wirings and metallic parts adjoining them for thereby allowing a desired current to be fed.

Each contact forming member 121, allowing the drum 12 and current return path to contact each other, includes the contact portions 125 contacting the conducive bearing 120 of the drum 12 and contact portion 124 contacting the shaft 12*a* of the drum 12 from the direction of thrust. Further, a resilient member constantly biases the leaf spring 121 in the axial direction from the back of the portion contacting the axis of the leaf spring 121 from the direction of thrust. The contact portions 125, which can thus be pressed against the bearing 120, and thrust-direction contact portion 124 executing a self-cleaning function derived from rotation on the shaft 12*a* from the direction of thrust cooperate make a return current stable. Moreover, the resilient member, biasing the leaf spring 121 from the back, prevents the contact forming member 121 from being brought out of contact with the shaft 12*a* or oscillating, thereby further stabilizing a return current.

In addition, the support plate 110 is located at the opposite side to the drum drive system with respect to the drums 12, contributing space saving.

In summary, it will be seen that the present invention provides an image forming apparatus capable of effecting stable charge control and having electric wirings which are easy and efficient to assemble and maintain and saves space.

Various modifications will become possible for those skilled in the art after receiving the teachings of the present disclosure without departing from the scope thereof.

What is claimed is:

1. An image forming apparatus comprising:

a rotatable image carrier;

a charger for uniformly charging a surface of said image carrier;

a pair of support plates supporting said image carrier at axially opposite ends of a rotary shaft on which said image carrier is mounted;

a current feed path for charging along which a current is fed from a high-tension power supply for charging to said charger; and a current return path for allowing a current to flow from said image carrier to a ground of said high-tension power supply for charging;

wherein the current flowing through said current return path is sensed in order to execute feedback control to an output of said high-tension power supply for charging, and one of said pair of support plates is openable and provided with a contact forming member comprising a member forming said current feed path for charging, a member forming said current return path and a plurality of contacts where said member forming said current return path and said image carrier contact each other.

2. The apparatus as claimed in claim 1, further comprising:

a developing device for developing a latent image formed on said image carrier to thereby produce a corresponding toner image;

an image transferring device for transferring the toner image to a recording medium;

a current feed path for development for allowing a current to be fed from a high-tension power supply for development to said developing device; and a current feed path for image transfer for allowing a current to be fed from a high-tension power supply for image transfer to said image transferring device;

wherein said member forming said current feed path for charging, a member forming said current feed path for image transfer and said member forming said current return path are isolated from each other by insulating members, and when said member forming said path for charging, said member forming said current feed path for development or said member forming said current feed path for image transfer and said member forming said current return path intersect substantially perpendicularly to each other when required to intersect each other.

3. The apparatus as claimed in claim 1, wherein said member forming said current feed path for charging comprises a thin conductive wire formed of metal.

4. The apparatus as claimed in claim 1, wherein said contact forming member comprises a conductive resilient member including a portion contacting a conductive bearing, which supports said image carrier, and a portion contacting the shaft of said image carrier from a direction of thrust, and a resilient member constantly biases said conductive resilient member from a back of said portion contacting the shaft of said image carrier from the direction of thrust in an axial direction of said shaft.

5. The apparatus as claimed in claim 1, wherein a drive system for driving said image carrier is mounted on the other support plate not openable.

* * * * *